US010244853B2

(12) United States Patent
Friedberg

(10) Patent No.: US 10,244,853 B2
(45) Date of Patent: Apr. 2, 2019

(54) APPARATUS AND METHOD FOR ASSISTING CARRYING OF OBJECTS BY HAND

(71) Applicant: Joseph Friedberg, Philadelphia, PA (US)

(72) Inventor: Joseph Friedberg, Philadelphia, PA (US)

( * ) Notice: Subject to any disclaimer, the term of this patent is extended or adjusted under 35 U.S.C. 154(b) by 659 days.

(21) Appl. No.: 14/072,285

(22) Filed: Nov. 5, 2013

(65) Prior Publication Data

US 2015/0125251 A1 May 7, 2015

(51) Int. Cl.
*A45F 5/10* (2006.01)
*A45F 3/14* (2006.01)

(52) U.S. Cl.
CPC ..... *A45F 5/10* (2013.01); *A45F 5/1026* (2013.01); *A45F 2003/142* (2013.01); *A45F 2005/1013* (2013.01); *A45F 2005/1033* (2013.01)

(58) Field of Classification Search
CPC .... A45F 5/10; A45F 5/1026; A45F 2003/142; A45F 2005/1013; A45F 2005/1033; A45F 5/102
USPC ..... 294/214, 137–172
See application file for complete search history.

(56) References Cited

U.S. PATENT DOCUMENTS 586,048 A * 7/1897 Lefebre, Jr. ..... A45F 5/10 294/150
1,222,973 A * 4/1917 Morter ..... B65G 7/12 294/15
4,942,995 A * 7/1990 Myers ..... A45C 13/30 224/257
5,131,707 A * 7/1992 Zazzara ..... A45F 5/10 294/153
5,150,938 A * 9/1992 Gans ..... A45F 5/1026 294/153
5,439,265 A * 8/1995 Plante ..... F16L 3/00 294/152
5,746,685 A * 5/1998 Glaser ..... A63B 21/4021 2/161.1
5,878,853 A * 3/1999 DeRouen ..... A45C 13/262 16/406
5,950,893 A * 9/1999 Heggeland ..... A45C 13/26 150/107
5,971,458 A * 10/1999 Contreras ..... A47G 25/1442 294/150
2003/0111856 A1* 6/2003 Hewett ..... B65G 7/12 294/150
2005/0173477 A1* 8/2005 Scott ..... A45F 5/02 224/148.6

(Continued)

FOREIGN PATENT DOCUMENTS

FR 1586589 A * 2/1970 ..... B65D 63/14
FR 2754986 A1 * 4/1998 ..... A45F 5/10

*Primary Examiner* — Gabriela M Puig
(74) *Attorney, Agent, or Firm* — Snyder, Clark, Lesch & Chung, LLP

(57) ABSTRACT

An apparatus and a method of using the apparatus for assisting in the carrying of an object having a handle are disclosed. The apparatus is in one embodiment a strap formed into a loop with a reinforcing member attached to a portion of the loop so as to create a rigid portion of the strap. The loop is passed through the handle of the object to be carried, with the rigid portion on the side of the handle away from the user. The user's hand is passed through the loop on the side facing the user and the user lets the weight of the object pull the loop onto the back of the user's wrist. The user can control the object by rotating the hand with minimal pressure by the fingers on the rigid portion of the loop.

3 Claims, 10 Drawing Sheets

(56) References Cited

U.S. PATENT DOCUMENTS

| | | | | |
|---|---|---|---|---|
| 2006/0085950 | A1* | 4/2006 | Udy | A45F 3/14 16/428 |
| 2007/0024071 | A1* | 2/2007 | Grbic | A45F 5/10 294/150 |
| 2008/0023975 | A1* | 1/2008 | Grbic | A45F 5/10 294/150 |
| 2008/0054663 | A1* | 3/2008 | Van Allen | A45F 5/021 294/145 |
| 2008/0061573 | A1* | 3/2008 | Lamson | A45F 5/10 294/150 |
| 2008/0303300 | A1* | 12/2008 | Hill | A45F 3/14 294/152 |
| 2009/0223019 | A1* | 9/2009 | Buchstaber | A45F 5/10 16/110.1 |
| 2010/0026025 | A1* | 2/2010 | McKay | A62B 35/0006 294/140 |
| 2011/0089710 | A1* | 4/2011 | Lee | A01M 31/006 294/153 |
| 2012/0200103 | A1* | 8/2012 | Estey | B65G 7/12 294/153 |
| 2013/0008934 | A1* | 1/2013 | Liu | A45F 3/02 224/627 |
| 2013/0145581 | A1* | 6/2013 | Bailey | A45F 5/102 16/422 |
| 2013/0270852 | A1* | 10/2013 | Adams | B65G 7/12 294/167 |
| 2014/0259551 | A1* | 9/2014 | Egbert | A45F 3/14 24/302 |
| 2014/0304952 | A1* | 10/2014 | Mathews | A45F 5/00 24/302 |

* cited by examiner

APPARATUS AND METHOD FOR ASSISTING CARRYING OF OBJECTS BY HAND

FIELD OF THE INVENTION

The present invention relates generally to handles and straps used in carrying of objects by hand.

BACKGROUND OF THE INVENTION

Carrying objects such as groceries, packages, luggage or brief cases is a daily part of life for most people. If one has arthritis, weakness or any other malady affecting the hand, carrying an object with a handle can be painful, potentially infeasible. Even without any disability a heavy object carried for a short time, or any object carried for a long time, can lead to fatigue and pain in the hand. Finally, carrying an object in one's hand typically precludes use of that hand for other activities such as opening a door or pressing an elevator button. This device could also be used for recreational purposes, such as weight lifting or other exercises where hand fatigue is a limitation.

The present invention fills a need that exists for an ergonomic device to transfer the load of a handle-borne object from the fingers to the much more powerful and fatigue resistant wrist and forearm, with the hand maintained in the anatomically natural and stable position of function. In addition, the present invention accomplishes the desired effect by also dispersing the pressure caused by the weight of the object over a greater surface area. The present invention does this in a way that allows the fingers to control the object, as though it were being supported in the fingers, yet have the weight of the object supported across a broader surface area on the more powerful wrist and forearm and allowing the fingers to be accessible fine motor tasks such as working a key—which would otherwise require releasing the carried object.

SUMMARY OF THE INVENTION

In accordance with an aspect of the present invention there is disclosed an apparatus to be used in conjunction with an object having handles to allow a person to carry and control the position of the object while taking some or all of the weight off of the person's fingers and transferring that weight to back of the hand, which can be flexed upwards in the opposite direction of flexure of the fingers, in the natural position of function.

DESCRIPTION OF THE DRAWINGS

The following drawings disclose various embodiments of the present invention for purposes of illustration only and are not intended to limit the scope of the invention. For purposes of clarity, not every component may be labeled in every figure.

FIG. 10 is an illustration of an exemplary apparatus including a padded area and a.

DETAILED DESCRIPTION OF THE PREFERRED EMBODIMENT

Figure 1:
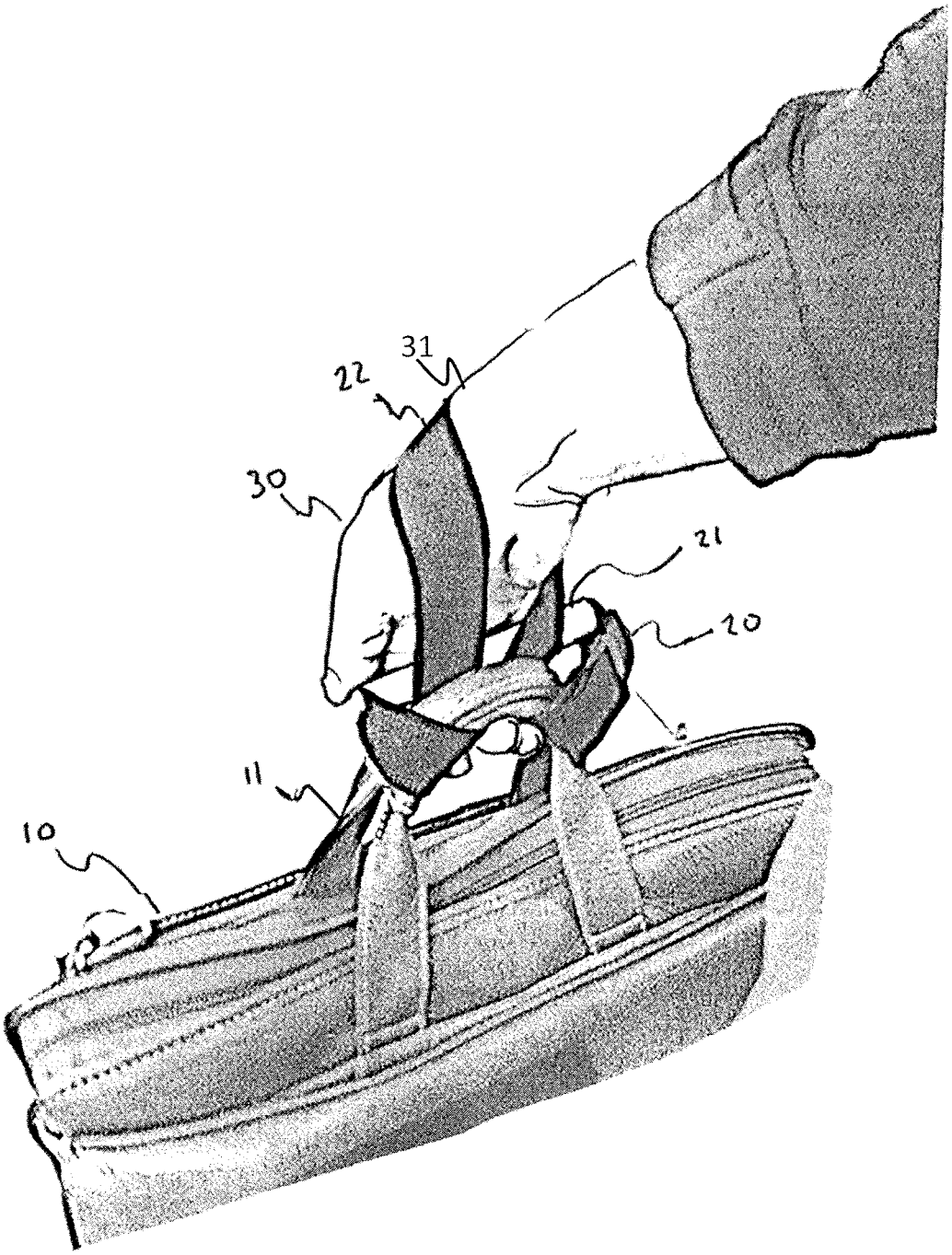
FIG. 1 is an illustration of an exemplary embodiment of an apparatus for assisting the carrying of an object having handles.
Figure 2:
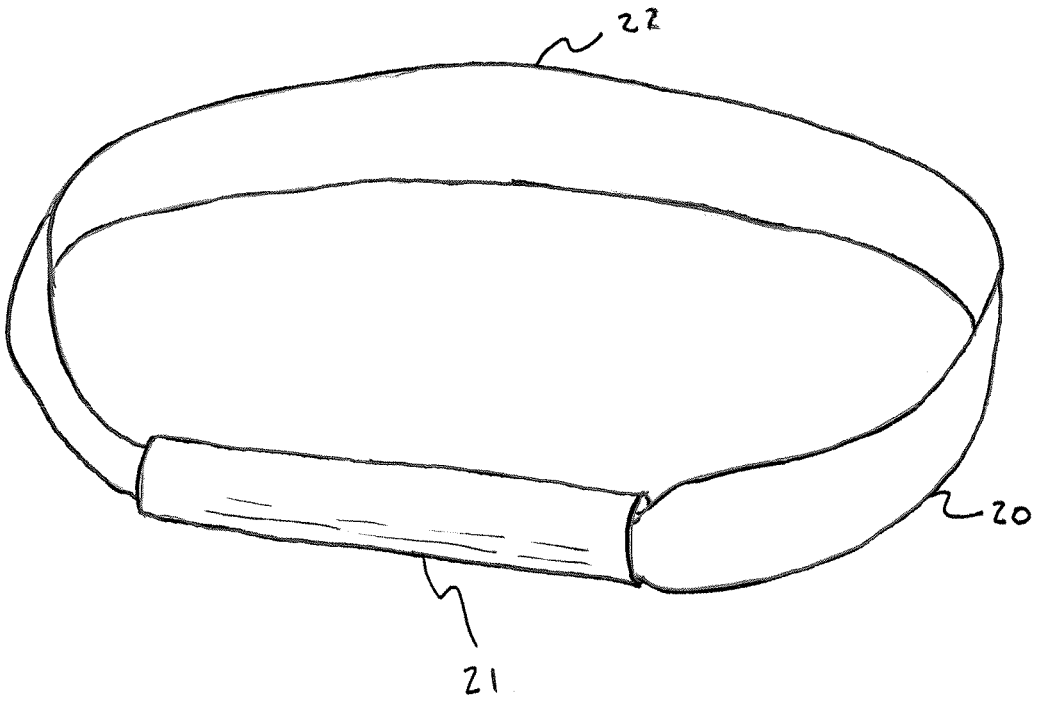
FIG. 2 is a stand-alone illustration of an exemplary embodiment of the apparatus of FIG. 1.

Referring now to the various figures of the drawing wherein like reference characters refer to like parts, there is shown in FIG. 1 an exemplary embodiment of the inventive apparatus in use while a user is carrying a briefcase 10 having a handle 11. The apparatus is a strap 20 formed into a loop, as shown in FIG. 2. The strap is augmented with a stiffening member 21, which in this embodiment is a tube 21, through which the strap is passed.

Figure 3:
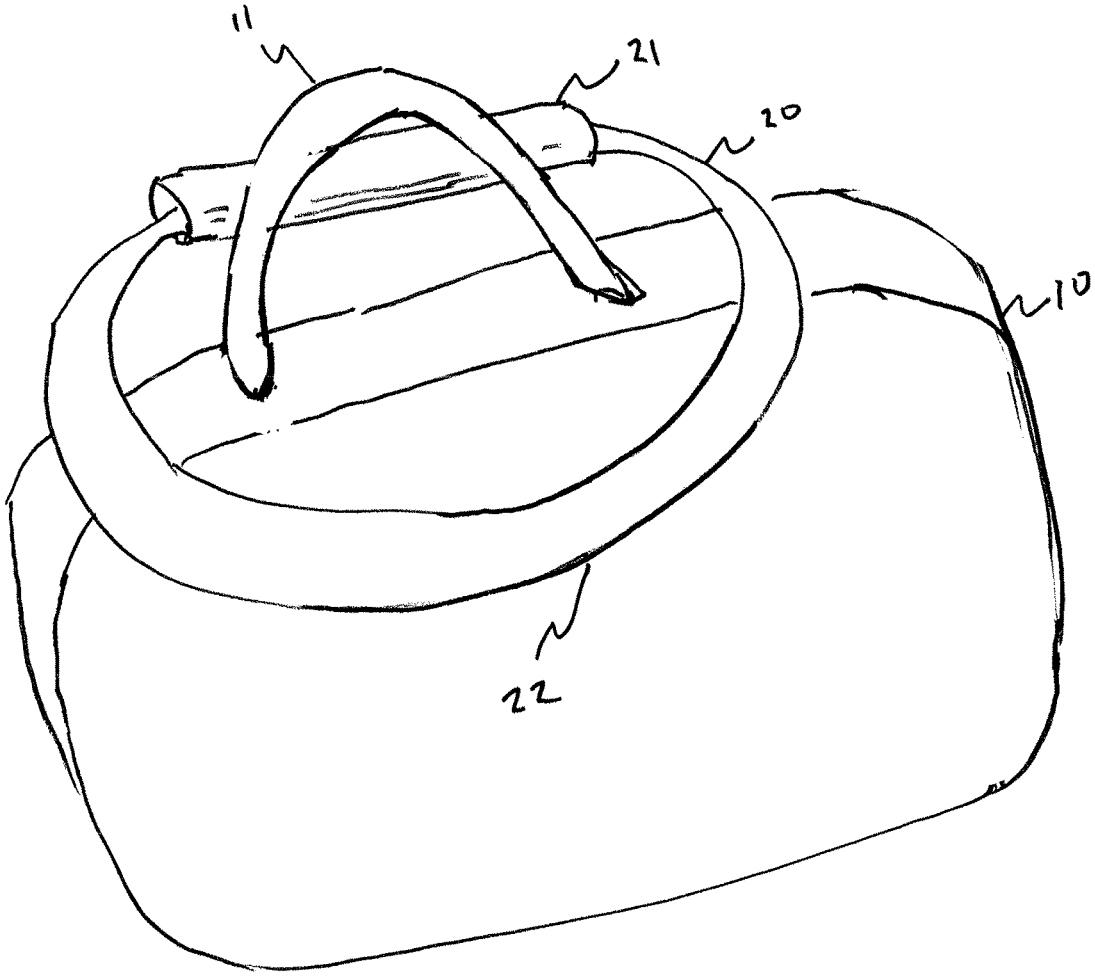
FIG. 3 is an illustration of a first step in applying the apparatus to a briefcase.
Figure 4:
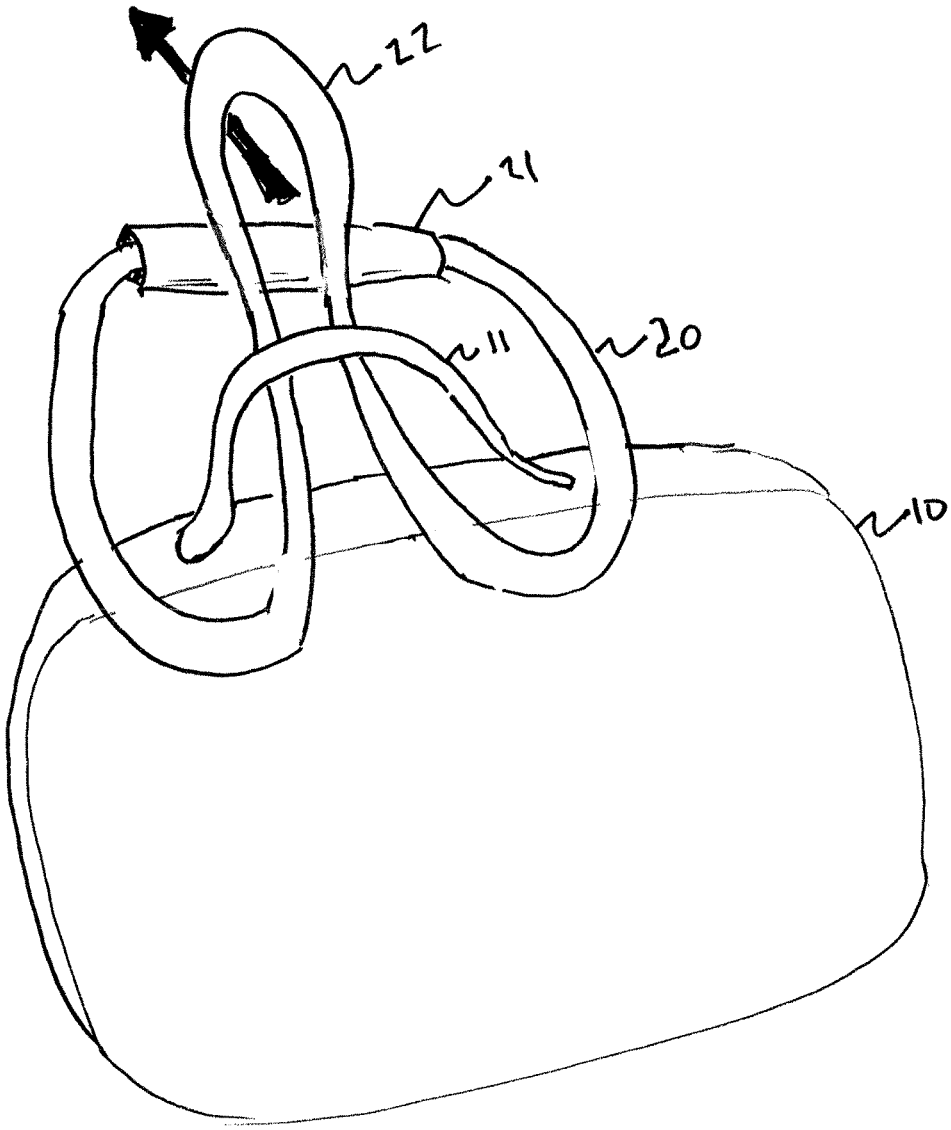
FIG. 4 is an illustration of a second step in applying the apparatus to a briefcase.
Figure 5:
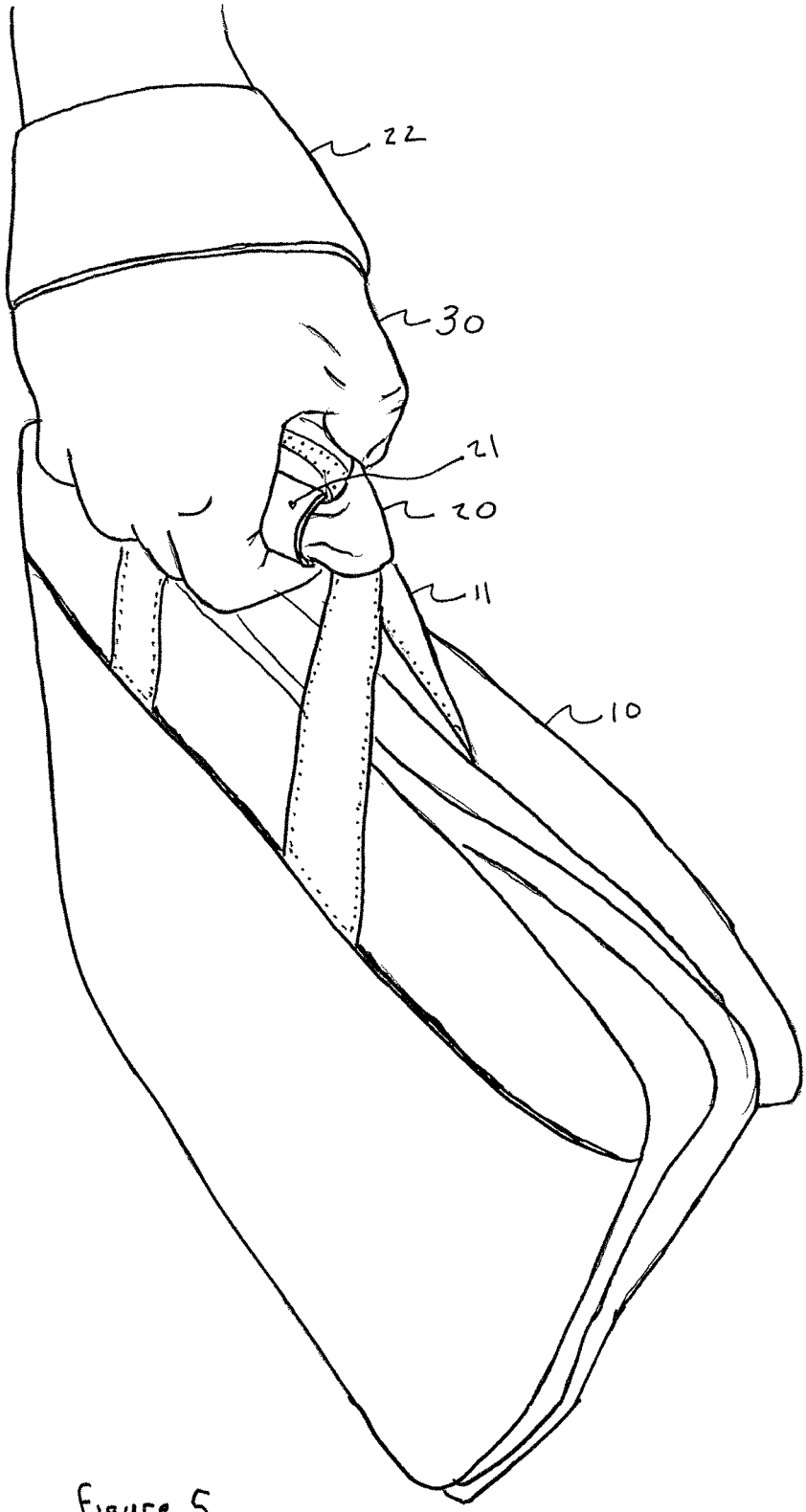
FIG. 5 is an illustration of the back view of a user's hand while holding an exemplary apparatus as applied to a briefcase.

As shown in FIGS. 3-5, the apparatus is used by placing the tube 21 at the distal side of the handle 11 and the loop of the strap 20 over the outside of the handle 11, with the flexible portion 22 of the strap 20, which is furthest from the tube, facing the user. The flexible portion 22 is then passed through the handle 11 over the tube 21 and pulled upwards on the distal side of the handle such that there is formed a loop through which the user's hand 30 can be placed. Once the loop is over the back of the user's wrist 31, the weight of the briefcase 10 can be allowed to fall onto the strap 20, thus cinching the strap against the back of the wrist 31 and allowing the user to carry the briefcase 10 with the load distributed to the back of the wrist 31. The device capitalizes on the fact that maintaining the hand in the neutral anatomic position, the position of function, is how the strap settles into position and is what makes the device comfortable for carrying.

The tube 21 keeps the strap 20 spread at the bottom so that the user has vertical axis rotational control in the axis over the object being carried. In an exemplary embodiment, the tube is sufficiently small in diameter to allow the user to grasp and control both the tube and the handle of the object being carried, while at the same time, the bulk of the weight of the object is carried by the strap supported by the user's wrist.

While in FIG. 1. the user's fingers 33 are shown curled somewhat around the tube 21 and the user can pull up with the fingers to accept a portion of the weight of the briefcase, it is not necessary to place any weight on the fingers and the briefcase can be carried solely by the force of the strap on the back of the wrist.

Figure 6:
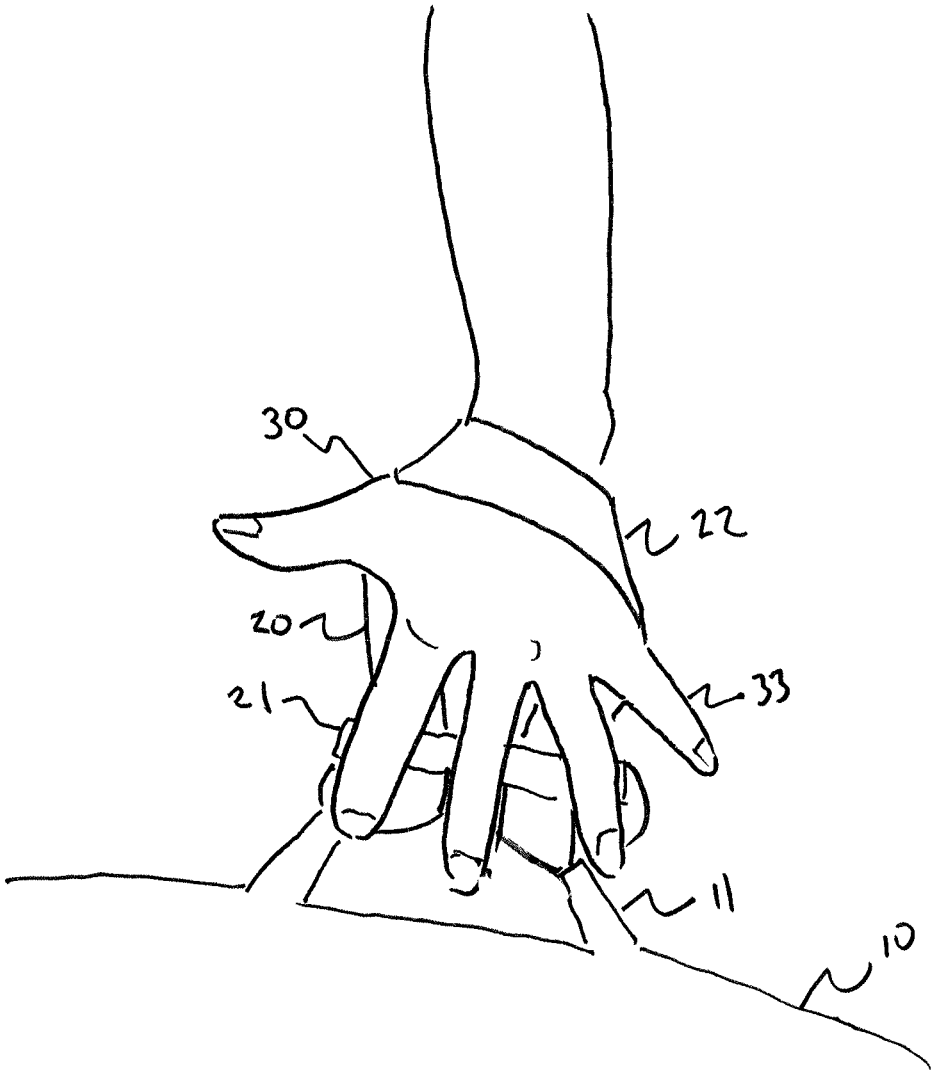
FIG. 6 is a further illustration of the back view of a user's hand while holding an exemplary apparatus as applied to a briefcase.
Figure 7:
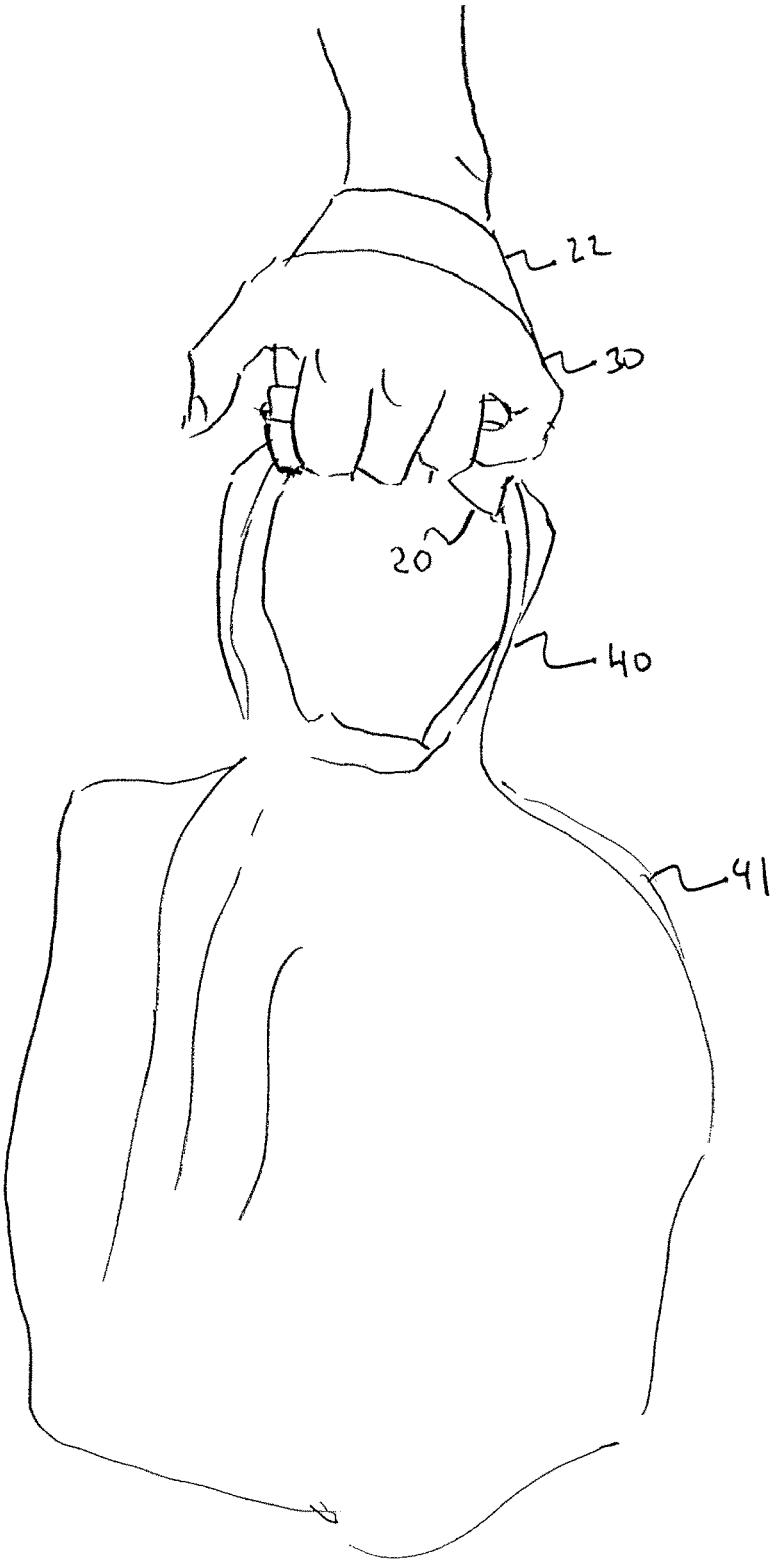
FIG. 7 is an illustration of an exemplary apparatus as applied to a plastic grocery bag.

The steps to assemble the apparatus through the handles of an object to be carried are shown in FIGS. 3 to 5. In FIG. 3, the apparatus is placed over the object's handle, with the tube 21 on the side away from the user. FIG. 4 shows the flexible portion 22 of the strap 20 that is opposite the tube 21 being passed through briefcase handle 11 and up between the tube 21 and the handle 11. FIG. 5 shows the user's hand 30 placed through the strap in preparation for allowing the weight of the briefcase 10 to be taken up by the user's wrist 31. FIG. 5 shows how the fingers 33 can be used to control the apparatus by grasping the tube 21. FIG. 6 shoes that the fingers 33 are not necessary to carry the briefcase 10 and that the weight of the apparatus and briefcase are solely supported by the user's wrist. FIG. 7 shows the apparatus used to hold a plastic grocery bag 41. The apparatus is attached to the bag's handles 40 in the same manner described above for the briefcase.

The apparatus is useful for aiding the carrying of a wide variety of objects having handles. An especially useful method is to use the apparatus to aid in the carrying of plastic shopping bags having handles. It is commonly known that the handles on such bags are not rigid and form a thin ribbon when the weight of the bag is carried by the user's fingers. A reasonably heavy payload in such a bag quickly becomes uncomfortable as the thin configuration the plastic handles places acute pressure on a small surface area of each of the fingers. Shoppers frequently carry a plurality of such bags when exiting a grocery store, with the weight of each bag concentrated in a small area of the fingers. By applying the inventive apparatus as shown in FIG. 6, the weight of the bags is distributed across the strap, which is much wider than the thickness of the handles of the plastic bags and the load is now transferred to the back of the wrist instead of the fingers.

In a further embodiment, the strap is adjustable in length to accommodate different wrist sizes and different handle sizes. The adjustment can include means such as D rings or a buckle or the like. In a further embodiment, the rigid portion of the device is not a tube but a stiffened portion of the strap. In a further embodiment, the rigid portion of the device is effected by a stiffening member such as rod or bar to be embedded within the strap as opposed to a tube through which the strap is threaded. In a further embodiment, the strap incorporates a receiving pocket into which a stiffening member such as a rod or a bar is placed. This embodiment allows for different length stiffening members to be used to accommodate a range of hand sizes. In a further embodiment, as shown in FIG. 5, the wrist portion of the strap 22 is contoured to better fit the shape of the wrist. In a further embodiment, the wrist portion of the strap is padded or made of a comfortable material such as leather or neoprene. In a further embodiment, the device incorporates a pocket within the flexible portion of the strap that allows the device to pack into itself like some raincoats and other kind of apparel do. In a further embodiment, the strap is built into the handle of an object such as a briefcase in which case the top portion of the handle of the briefcase forms the stiffening function.

In a further embodiment, the stiffening member 21 can be adjustable in length to accommodate different sized hands or loads. One means of making the member adjustable is for it to be telescoping with a locking means such as is well known in the art of such telescoping rods, for example a locking means that is effected by twisting two telescoping portions so that an internal wedge that is attached to the smaller diameter telescoping portion is tightened against the inside wall of the larger diameter telescoping portion. The two telescoping portions could also be partially threaded, the larger diameter portion having an internal thread and the smaller diameter portion having an external thread. The two telescoping portions could also be incrementally adjustable with the inner portion having spring-loaded tangs that fit into holes or slots on the outer portion. This form of telescoping adjustable part can have a variety of cross sections and is not limited to circular cross sections as are the two previous examples.

Figure 8:
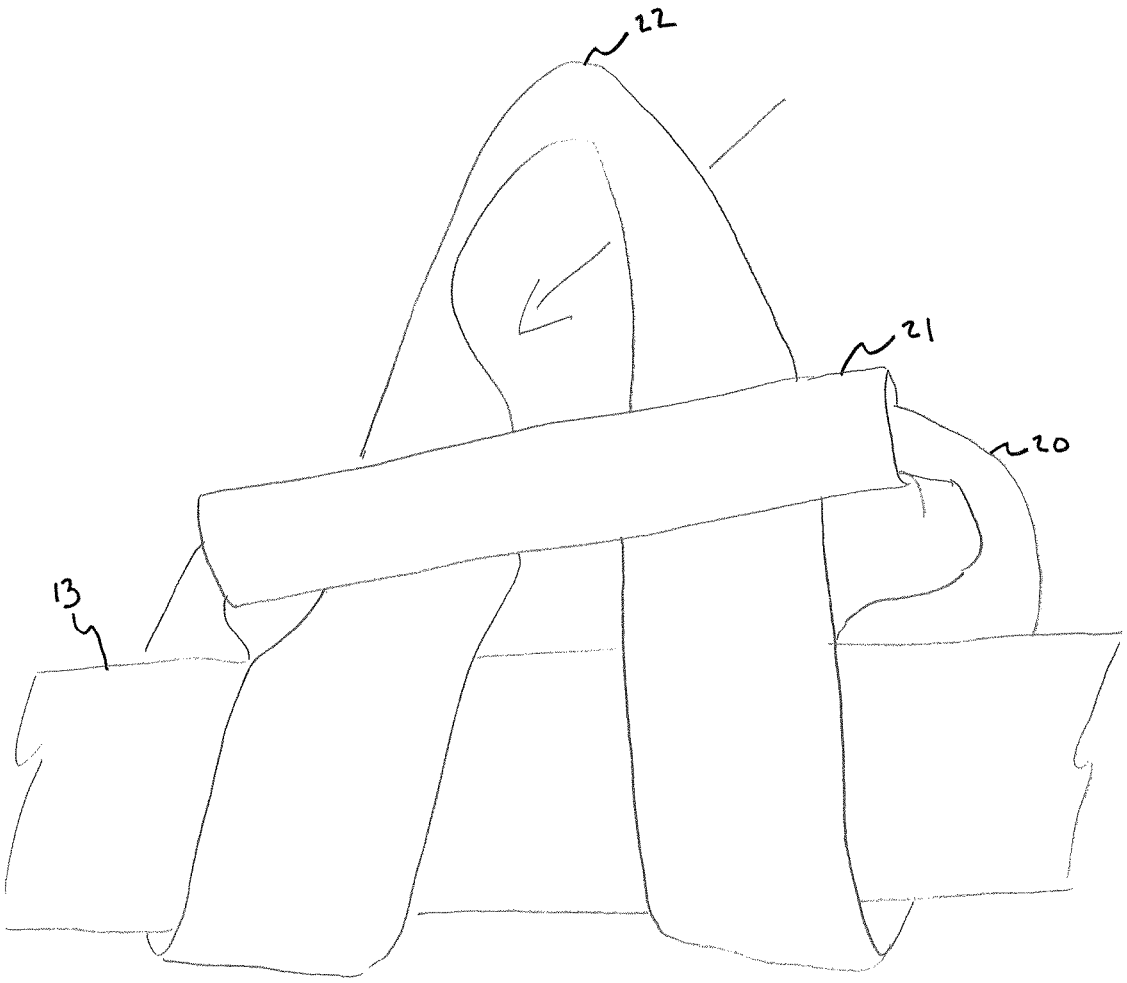
FIG. 8 is an illustration of an exemplary apparatus as applied to a rigid bar.

In a further embodiment illustrated in FIG. 8, the strap can be looped around a bar 13 such as a weightlifting barbell or a chin-up bar where hand fatigue might limit the amount of weight or number of repetitions of a desired exercise. This embodiment can be performed by the following method: placing a strap 20 or a loop of substantially flexible material 24 having a rigid portion 21 at a first end of the loop and a flexible portion 22 at a second end of the loop under the rod or bar 13, with the rigid portion 21 facing the user; passing the flexible potion 22 over the bar and back towards the user; passing the flexible portion 22 between the rigid portion and the bar 13; passing the person's hand through the flexible portion as indicated by the arrow in FIG. 8; pulling up the flexible portion to tighten the loop around the bar 13 by allowing its weight to fall onto the user's wrist via the loop of flexible material.

Figure 9:
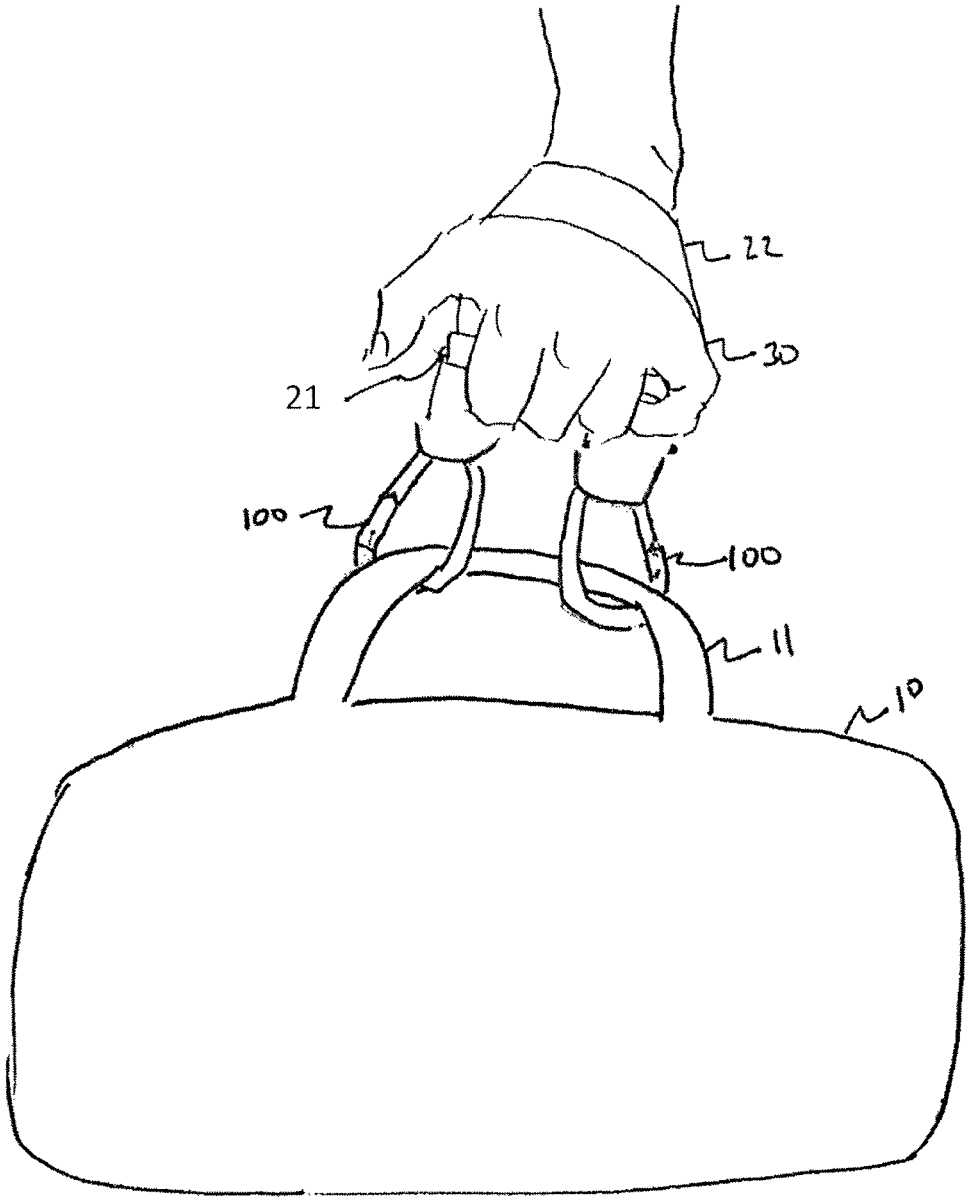
FIG. 9 is an illustration of an exemplary apparatus combined with carabineers.

FIG. 9 shows an application of an exemplary apparatus wherein, rather than looping the strap 20 through the carried object's handle 11 as described above, the loops of the strap are attached to carabiners 100. Carabiners or the like allow quick attachment to the handle 11 without having to adjust the strap length to accommodate different handle dimensions.

Figure 10:
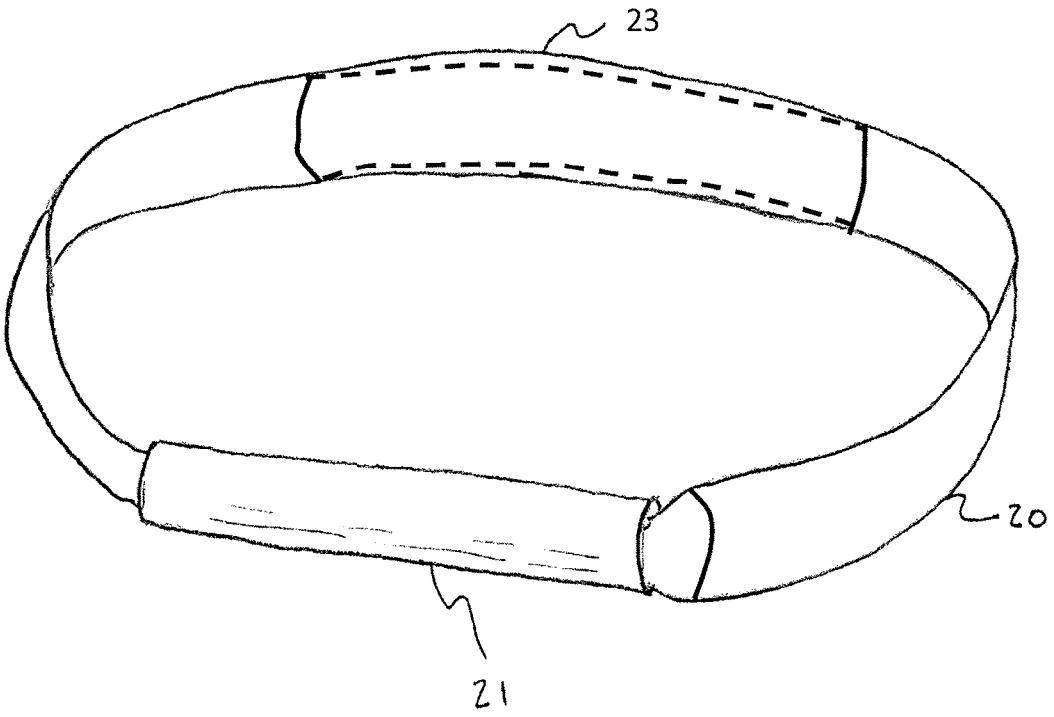

In a further embodiment, shown in FIG. 10, the loop of flexible material includes padding 23 at said proximal end, with the padding arranged to contact the back of the person's wrist.

Without further elaboration the foregoing will so fully illustrate my invention that others may, by applying current or future knowledge, adopt the same for use under various conditions of service.

I claim:

1. An apparatus for assisting a person in hand carrying objects having handles, by distributing most of the weight of the object to the person's wrist comprising:

a loop of flexible material having a loop perimeter length, and a loop stiffener located along a first portion of said loop, said loop stiffener spanning less than one third of said loop perimeter length and configured for control of the object by the person's fingers, said loop of flexible material comprising padding only at a second portion of said loop, said padding being adapted for padding the wrist and wherein portions of said loop of flexible material not covered by said padding are adapted for supporting the object at two contact points and wherein said second portion is wider than the remainder of the loop of flexible material and is contoured to fit the wrist.

2. The apparatus of claim 1, wherein said loop stiffener is a tube through which the flexible material of the loop is passed.

3. The apparatus of claim 1, wherein the flexible material is a strap having a thin and substantially-rectangular cross section.

* * * * *